US010231041B2

(12) United States Patent
Miao et al.

(10) Patent No.: US 10,231,041 B2
(45) Date of Patent: Mar. 12, 2019

(54) LOUDSPEAKER MODULE

(71) Applicant: GOERTEK INC., WeiFang, Shandong (CN)

(72) Inventors: Qing Miao, WeiFang (CN); Chao Xu, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/532,962

(22) PCT Filed: Nov. 11, 2015

(86) PCT No.: PCT/CN2015/094266

§ 371 (c)(1),
(2) Date: Jun. 2, 2017

(87) PCT Pub. No.: WO2016/086759

PCT Pub. Date: Jun. 9, 2016

(65) Prior Publication Data

US 2017/0311061 A1 Oct. 26, 2017

(30) Foreign Application Priority Data

Dec. 5, 2014 (CN) ..... 2014 1 0736697

(51) Int. Cl.
*H04R 1/02* (2006.01)
*H04R 1/28* (2006.01)
(Continued)

(52) U.S. Cl.
CPC ..... *H04R 1/025* (2013.01); *H04R 9/025* (2013.01); *H04R 9/06* (2013.01); *H04R 1/2819* (2013.01);
(Continued)

(58) Field of Classification Search
CPC ..... H04R 1/025; H04R 9/025; H04R 9/06
(Continued)

(56) References Cited

U.S. PATENT DOCUMENTS

2010/0329496 A1* 12/2010 Mottonen ..... H04M 1/0245 381/349
2014/0069736 A1 3/2014 Freshman et al.

FOREIGN PATENT DOCUMENTS

CN 203554669 U 4/2014
CN 203608327 U 5/2014
(Continued)

OTHER PUBLICATIONS

International Search Report dated Jan. 27, 2016 of PCT/CN2015/094266 which is the parent application and its English translation—4 pages.

*Primary Examiner* — Sean H Nguyen
(74) *Attorney, Agent, or Firm* — Knobbe Martens Olson & Bear LLP

(57) ABSTRACT

Disclosed is a loudspeaker module which comprises a housing and a loudspeaker unit accommodated in the housing. The housing comprises a front cover, a first housing and a second housing, and a cavity is defined by the front cover, the first housing and the second housing. The loudspeaker unit is fixed in the cavity, and the cavity is divided into a front cavity and a rear cavity by the loudspeaker unit. The front cavity is a cavity defined by the loudspeaker unit, the front cover and the first housing. The loudspeaker unit comprises a vibration system and a magnetic circuit system. The front cover is provided with a chamber corresponding to a mounting position of the loudspeaker unit, and the cavity is isolated from the front cavity and the rear cavity and is provided with a ventilation structure in communication with external environment.

7 Claims, 2 Drawing Sheets

(51) Int. Cl.
*H04R 9/02* (2006.01)
*H04R 9/06* (2006.01)

(52) U.S. Cl.
CPC ..... *H04R 1/2842* (2013.01); *H04R 2499/11* (2013.01)

(58) Field of Classification Search
USPC ..... 381/386
See application file for complete search history.

(56) References Cited

FOREIGN PATENT DOCUMENTS

| | | | |
|---|---|---|---|
| CN | 104519449 | A | 4/2015 |
| JP | 6-141398 | A | 5/1994 |

* cited by examiner

LOUDSPEAKER MODULE

TECHNICAL FIELD

The present invention relates to the field of electroacoustics, and more particularly to a loudspeaker module.

BACKGROUND ART

With the expansion of consumer electronics market, a large number of consumer electronics, such as mobile phones, notebook computers and the like, have been widely promoted. The loudspeaker module has a wide range of requirements as an important acoustic component in consumer electronics. With the improvement of the sound quality requirements for consumer electronics, the performance of the loudspeaker module has also been concerned increasingly.

The loudspeaker module is an energy conversion device. The loudspeaker module comprises a case formed by combining a front cover with two housings, and a loudspeaker unit accommodated in the case. The loudspeaker unit comprises a vibration system and a magnetic circuit system, and the inner cavity of the entire module is divided into two cavities by the loudspeaker unit, that is, a front sound cavity and a rear sound cavity. The front sound cavity is in communication with the exterior of the module through a sound hole so as to spread sound, and the rear sound cavity is a sealed cavity. A loudspeaker module in traditional technology has a relatively fixed structure and similar acoustic performance. As the customer's requirement for the performance of the loudspeaker module is increasingly higher, a loudspeaker module with a general design is not much improved, and cannot meet the requirement for further improvements in acoustic performance of the loudspeaker module.

Therefore, it is necessary to propose an improvement so as to improve the acoustic performance of the loudspeaker module.

SUMMARY

The technical problem to be solved by the present invention is to provide a loudspeaker module with good acoustic performance.

In order to achieve the above object, the present invention adopts the following technical scheme: a loudspeaker module comprises a housing and a loudspeaker unit accommodated in the housing. The housing comprises a front cover, a first housing and a second housing, and a cavity is defined by the front cover, the first housing and the second housing. The loudspeaker unit is fixed in the cavity, and the cavity is divided into a front cavity and a rear cavity by the loudspeaker unit. The front cavity is a cavity defined by the loudspeaker unit, the front cover and the first housing. The loudspeaker unit comprises a vibration system and a magnetic circuit system. The front cover is provided with a chamber corresponding to a mounting position of the loudspeaker unit, the chamber is isolated from the front cavity and the rear cavity, and the chamber is provided with a ventilation structure in communication with external environment.

As a preferred embodiment, the chamber has a volume of 0.1 cubic centimeters.

As a preferred embodiment, the coverage area of the chamber in the first housing is less than the area of the vibration system of the loudspeaker unit.

As a preferred embodiment, the ventilation structure is provided on a lateral side of the housing. As a further preferred, the ventilation structure is a ventilation opening.

As a preferred embodiment, the front cavity is provided with a sound hole in communication with the front cavity and the external environment, and the sound hole is provided on a lateral side of the housing.

As a further preferred embodiment of the present invention, the magnetic circuit system comprises a magnetic yoke, and the second housing is provided with an opening at a position corresponding to the magnetic yoke, and the magnetic yoke extends through the opening.

In the loudspeaker module of the present invention, a chamber is provided at the position of the front cavity of the module, the chamber is isolated from the front cavity and the rear cavity, and the chamber and the external environment are provided with an opening. The front cavity space is divided by the chamber, which can effectively improve the frequency response curve of the loudspeaker product, and adjust the high frequency performance of the loudspeaker module. At the same time, the front cavity structure of the loudspeaker module is optimized by the chamber, which can effectively improve the resonance phenomenon of certain frequencies in the front cavity, enrich the listening sensation of the loudspeaker product and improve the high frequency THD. Therefore, the loudspeaker module of the present invention has the advantage of good acoustic performance.

As a preferred embodiment, the chamber has a volume of 0.1 cubic centimeters, and the chamber of 0.1 cubic centimeters is an independent space divided from the front cavity space so as to improve the acoustic performance of the loudspeaker module without additionally increasing the external space of the loudspeaker module.

In order to improve the acoustic performance of the loudspeaker module without simultaneously affecting the internal space of the loudspeaker, the area of the chamber is smaller than the area of the vibration system of the loudspeaker unit. That is, the cross-sectional area of the chamber is smaller than that of the unit, the chamber can be provided above the unit, occupy only part of the front cavity space and produce no effect on the interior of the loudspeaker module and the rear cavity space.

In order to improve the flexibility of the chamber arrangement in accordance with the overall appearance of the loudspeaker module, the cavity of the chamber is a front cover structure without the addition of loudspeaker module components. In order to ensure the loudspeaker acoustic performance adjustment function of the chamber, the ventilation structure, in which the chamber is in communication with the external, can be provided at a lateral side of the loudspeaker module.

In the loudspeaker module of the invention, the front cavity of the module is provided with an isolated chamber which can improve the acoustic performance of the loudspeaker module. Therefore, the loudspeaker module of the invention has the advantages of good acoustic performance.

DETAILED DESCRIPTION OF EMBODIMENTS

Hereinafter, the contents of the present invention will be described in detail with reference to the accompanying drawings.

Embodiment

Figure 1:
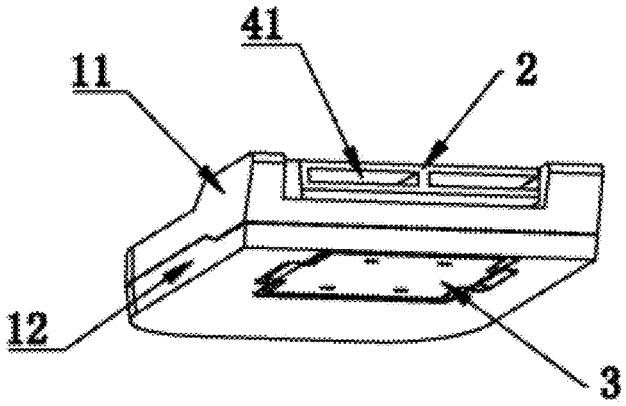
FIG. 1 is a perspective view of a specific embodiment of the loudspeaker module of the present invention.
Figure 3:
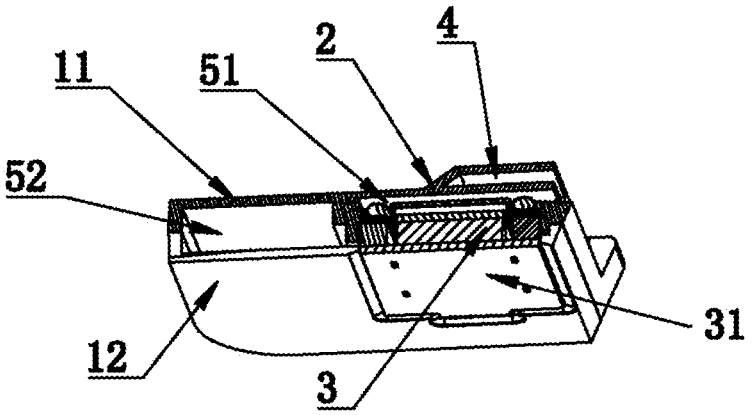
FIG. 3 is a cross-sectional view of the loudspeaker module shown in FIG. 1.

As shown in FIG. 1, a loudspeaker module according to an embodiment of the present invention comprises a housing which comprises a first housing 11, a second housing 12, and a front cover 2. The housing is provided with a loudspeaker unit 3 therein. A chamber in which the loudspeaker unit 3 is disposed is defined by the first housing 11, the second housing 12 and the front cover 2. As shown in FIG. 3, the chamber is divided into a front cavity 51 and a rear cavity 52 by the loudspeaker unit 3. The front cavity 51 is a chamber defined by the loudspeaker unit 3, the first housing 11, and the front cover 2. The front cavity 51 is provided with a sound hole in communication with the exterior, and the sound hole is used for spreading the sound of the loudspeaker unit 3.

Figure 2:
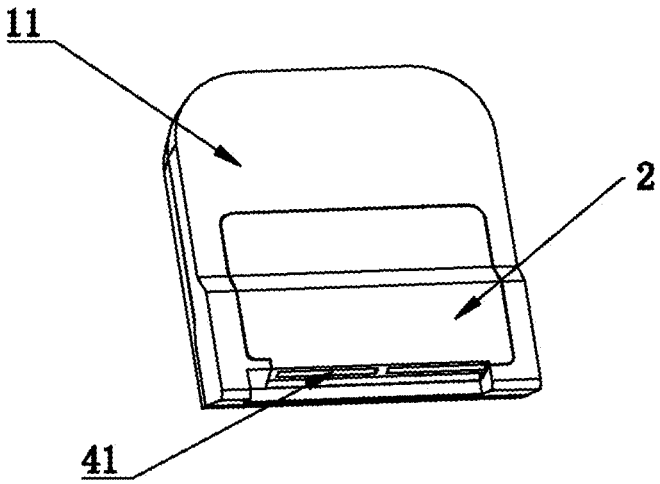
FIG. 2 is a perspective view of another aspect of the loudspeaker module shown in FIG. 1.
Figure 4:
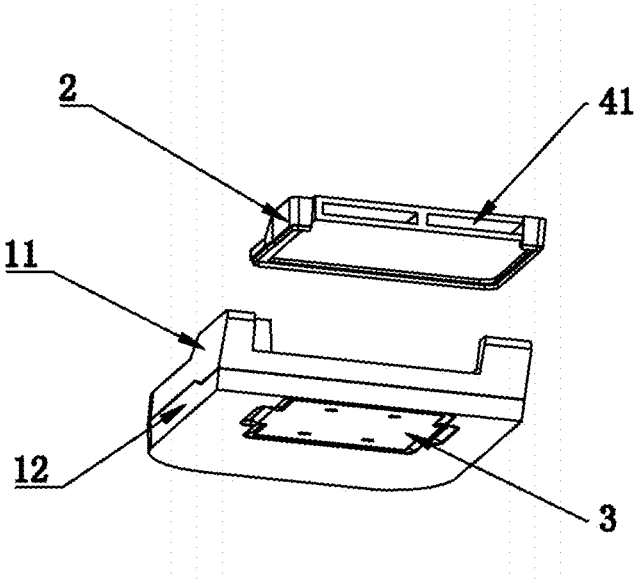
FIG. 4 is an exploded view of the front cover of the loudspeaker module shown in FIG. 1.

As shown in FIG. 3, in the loudspeaker module of the present invention, the front cover 2 is provided with a chamber 4 corresponding to the position of the loudspeaker unit 3. The chamber 4, the front cavity 51 and the rear cavity 52 are provided in isolation from each other. As shown in FIGS. 1, 2 and 4, the chamber 4 is provided with a ventilation opening 41 in communication with the exterior. In the present embodiment, the ventilation opening 41 is provided at a lateral side of the loudspeaker module. However, in the practical application process, the ventilation opening is other ventilation structure and provided in other position according to actual requirements, by which the advantages of the loudspeaker module of the present invention can also be realized. In the loudspeaker module of the present invention, the arrangement of the chamber 4 improves the volume and resonance of the front cavity. The space of the front cavity 51 is divided by the chamber 4, which effectively improves the frequency response curve of the product, and adjusts the high frequency performance of the product. The structure of the front cavity 51 of the loudspeaker module is optimized by the chamber 4, which effectively improves the resonance phenomenon of certain frequencies in the front cavity 51, enriches the listening sensation of the loudspeaker product, improves the high frequency THD, and improves the performance of the loudspeaker module. In the loudspeaker module of the present embodiment, the sound hole of the front cavity 51 in communication with the exterior is provided at the lateral side of the housing of the loudspeaker module. The sound hole is a slit structure between the front cover 2 and the first housing 11. In the practical application process, the sound hole may be provided in other position based on the design requirements of the loudspeaker module, which does not affect the advantages of the loudspeaker module of the present invention.

As shown in FIG. 3 and FIG. 4, the chamber 4 is the structure of the front cover 2, and thus the loudspeaker module is assembled without adding other additional components, and without increasing steps for assembling the loudspeaker module.

In the practical application process, when the volume of the chamber 4 is 0.1 cubic centimeters, the chamber 4 maximizes the improvement of the acoustic performance of the loudspeaker module, and the cavity is small, which does not additionally increase an oversize external volume of the loudspeaker module.

As shown in FIG. 3, in the loudspeaker module of the present invention, the area of the chamber 4 is smaller than that of the vibration system of the loudspeaker unit. The area of the chamber 4 is smaller than that of the vibration system of the loudspeaker unit 3 so as to ensure that the cross-sectional area of the chamber 4 is smaller than that of the loudspeaker unit 3, and the chamber 4 occupies only the partial space of the cavity 51, which does not affect the volume of the loudspeaker unit 3 and the space of the rear cavity 52.

As shown in FIG. 3, in the loudspeaker module of the present embodiment, the loudspeaker unit 3 comprises a magnetic circuit system which comprises a magnetic yoke 31, the second housing 12 is provided with an opening corresponding to the mounting position of the loudspeaker unit 3, and the magnetic yoke 31 extends through the opening of the second housing 12. The outer surface of the magnetic yoke 31 is flush with the outer surface of the second housing. This structure design increases the volume of the loudspeaker unit 3, and is conducive to improve the acoustic performance of the loudspeaker module. Further, the magnetic yoke 31 extends through the second housing 12, which facilitates dissipation of heat during the operation of the loudspeaker unit 3, thereby preventing the loudspeaker module from being deteriorated due to the high temperature of the loudspeaker unit 3, and improving the reliability of the loudspeaker module.

In the loudspeaker module of the present invention, the front cover defining the front cavity is provided with a chamber which is isolated from the front cavity, and the front cavity space is divided by the chamber, which effectively improves the frequency response curve of the loudspeaker module, and adjusts the high frequency performance of the loudspeaker module. In the meantime, the structure of the front cavity of the loudspeaker module is optimized by the chamber, which effectively improves the resonance phenomenon of certain frequencies in the front cavity, enriches the listening sensation of the loudspeaker module, improves the high frequency THD, and improves the acoustic performance of the loudspeaker module. Therefore, the loudspeaker module of the present invention has the advantage of good acoustic performance.

The above-mentioned contents are only embodiments of the present invention and are not for limiting the present invention, thus the equivalent modification or variation made by those skilled in the art according to the present invention should be incorporated into the scope of protection recorded in the claims.

The invention claimed is:

1. A loudspeaker module, comprising a housing and a loudspeaker unit accommodated in the housing, wherein the housing comprises a front cover, a first housing and a second housing, and a cavity is defined by the front cover, the first housing and the second housing, wherein the loudspeaker unit is fixed in the cavity, the cavity is divided into a front cavity and a rear cavity by the loudspeaker unit, and the front cavity is a cavity defined by the loudspeaker unit, the front cover and the first housing, wherein the loudspeaker unit comprises a vibration system and a magnetic circuit system, wherein the front cover comprises a chamber located at a position corresponding to that of the loudspeaker unit, the chamber is isolated from the front cavity and the rear cavity, and the chamber is provided with a ventilation structure in communication with external environment, wherein the front cover is located above the front cavity so that the chamber is adjacent to the front cavity, wherein the loudspeaker unit, the front cavity and the chamber are arranged in order along a direction such that the front cavity is located between the loudspeaker unit and the chamber.

2. The loudspeaker module according to claim 1, wherein the chamber has a volume of 0.1 cubic centimeters.

3. The loudspeaker module according to claim 1, wherein an area of the chamber is smaller than that of the vibration system of the loudspeaker unit.

4. The loudspeaker module according to claim 1, wherein the ventilation structure is provided at a lateral side of the housing.

5. The loudspeaker module according to claim 1, wherein the ventilation structure is a ventilation opening.

6. The loudspeaker module according to claim 1, wherein the front cavity is provided with a sound hole in communication with the front cavity and the external environment, and the sound hole is provided at a lateral side of the housing.

7. The loudspeaker module according to claim 1, wherein the magnetic circuit system comprises a magnetic yoke, the second housing is provided with an opening at a position corresponding to the magnetic yoke, and the magnetic yoke extends through the opening.

* * * * *